US009333785B2

(12) United States Patent
Sano et al.

(10) Patent No.: US 9,333,785 B2
(45) Date of Patent: May 10, 2016

(54) APPARATUS AND METHOD FOR FORMING THERMAL TRANSFER PRINTING SHEET, THERMAL TRANSFER PRINTING SHEET AND THERMAL TRANSFER PRINTING METHOD

(75) Inventors: Tomohumi Sano, Iruma (JP); Toshiaki Kanamura, Oume (JP); Satoshi Mitsui, Tokyo (JP)

(73) Assignees: CASIO ELECTRONICS MANUFACTURING CO., LTD., Saitama (JP); CASIO COMPUTER CO., LTD., Tokyo (JP)

( * ) Notice: Subject to any disclaimer, the term of this patent is extended or adjusted under 35 U.S.C. 154(b) by 643 days.

(21) Appl. No.: 13/607,488

(22) Filed: Sep. 7, 2012

(65) Prior Publication Data

US 2013/0078009 A1 Mar. 28, 2013

(30) Foreign Application Priority Data

Sep. 26, 2011 (JP) ..... 2011-208441

(51) Int. Cl.

| | |
|---|---|
| ***G03G 15/00*** | (2006.01) |
| ***B41M 3/12*** | (2006.01) |
| ***B41M 5/025*** | (2006.01) |
| ***B41M 5/03*** | (2006.01) |

(52) U.S. Cl.

CPC ..... *B41M 3/12* (2013.01); *B41M 5/0256* (2013.01); *B41M 5/03* (2013.01); *G03G 15/00* (2013.01)

(58) Field of Classification Search

CPC ..... G03G 8/00; G03G 16/00
USPC ..... 399/299, 341, 342
See application file for complete search history.

(56) References Cited

U.S. PATENT DOCUMENTS

| | | | | |
|---|---|---|---|---|
| 7,208,251 | B2 | 4/2007 | Egusa et al. | |
| 2010/0105836 | A1* | 4/2010 | Mawatari et al. | 525/71 |
| 2012/0237698 | A1 | 9/2012 | Funahashi et al. | |

FOREIGN PATENT DOCUMENTS

| | | | |
|---|---|---|---|
| GB | 2329480 | A | 3/1999 |
| JP | 58-120060 | U | 8/1983 |
| JP | 61-76397 | A | 4/1986 |
| JP | 61-105194 | U | 7/1986 |
| JP | 5-077557 | A | 3/1993 |

(Continued)

OTHER PUBLICATIONS

Sano (JP 2011-107418 A) Jun. 2011, JPO Computer Translation; Ozaki (JP 2003-154793 A) May 2003, JPO Computer Translation.*

(Continued)

*Primary Examiner* — Erika J Villaluna
(74) *Attorney, Agent, or Firm* — Holtz, Holtz & Volek PC

(57) ABSTRACT

There is provided an apparatus for forming a thermal transfer printing sheet. The apparatus includes: a release sheet feeder that feeds a release sheet having a release surface; a first image forming section that transfers an image, which is to be thermally transferred and printed on a transfer medium, onto the release surface of the release sheet; a second image forming section that forms a thermoplastic resin pattern corresponding to the image as a transfer base material and transfers the thermoplastic resin pattern onto the release surface of the release sheet; and a fixing section that fixes the image and the thermoplastic resin pattern onto the release surface of the release sheet in a film shape, through heat and pressure.

18 Claims, 8 Drawing Sheets

(56) References Cited

FOREIGN PATENT DOCUMENTS

| | | | | |
|---|---|---|---|---|
| JP | 7-336466 | A | | 12/1995 |
| JP | 8-207263 | A | | 8/1996 |
| JP | 9-087980 | A | | 3/1997 |
| JP | 11-157139 | A | | 6/1999 |
| JP | 2002-154724 | A | | 5/2002 |
| JP | 2003-154793 | A | | 5/2003 |
| JP | 2004-133413 | A | | 4/2004 |
| JP | 2005125292 | A | * | 5/2005 |
| JP | 2008179027 | A | | 8/2008 |
| JP | 2011107418 | A | * | 6/2011 |
| JP | 4765810 | B2 | | 9/2011 |
| JP | 2012-192706 | A | | 10/2012 |

OTHER PUBLICATIONS

Chinese Office Action dated May 28, 2014 in counterpart Chinese Application No. 201210363869.3.

Japanese Office Action dated Nov. 20, 2012 (and English translation thereof) in counterpart Japanese Application No. 2011-208441.

* cited by examiner

18

18
49

18
49
48

50b
18
49
48

HEAT, PRESSURE
51
50b
50b-1
50b-2
18
52
48
49

53b
52
48a
49

18

18
48
48

18
48

18
48
49d
48

18
48
50d
49d
48

HEAT, PRESSURE
51
50d
50d-1
48
52
49d
48
50d-2
18

52
49d
53d
48a
49d

APPARATUS AND METHOD FOR FORMING THERMAL TRANSFER PRINTING SHEET, THERMAL TRANSFER PRINTING SHEET AND THERMAL TRANSFER PRINTING METHOD

FIELD

The present invention relates to an apparatus and method for forming a thermal transfer printing sheet, a thermal transfer printing sheet and a thermal transfer printing method.

BACKGROUND

In the past, there has been a method of forming a label with glue. A method of printing a pattern on a label sheet, in which a back surface to which an adhesive is applied, is detachably attached to a release sheet, and cutting the label sheet in an arbitrary shape using a blade is generally used as the method of forming a label.

The method of forming a label does not have any particular problems when a large number of labels are formed. However, when a small number of labels are formed, the manufacturing costs of a blade, which is used to cut a plate on which a pattern is printed and the pattern, are basically high. As a result, there is a problem in that the unit price of a label is increased.

The present applicant has proposed a method of forming a label by transferring a toner-like composition onto a release sheet, which includes an adhesive layer on the surface thereof, in an arbitrary shape using an electrophotographic system and heating the toner-like composition as described in Japanese Patent No. 4765810.

Meanwhile, a method and apparatus for directly printing a design on an object, which is to be printed, using an inkjet printer is proposed in JP-A-07-336466 and JP-A-08-207263, as a method of printing designs, such as desired images or logos, on fabric products, such as T-shirts, trainers, and work clothes, wood, metal plate, and the like.

Further, an apparatus for directly printing on fabrics such as clothes using a thermal transfer printer is proposed in JP-A-11-157139.

Furthermore, a method and apparatus for thermally transferring an image onto a printing medium using an iron or the like after printing the image on a transfer sheet are proposed in JP-A-05-077557 and JP-A-09-087980.

However, since a release sheet on which an adhesive is applied in advance is used in Japanese Patent No. 4765810, there are problems in that the release sheet is expensive and a problem such as transformation processing for removing adherence on the surface exposed to an adhesive outside the outline of the label is required after development processing.

The inkjet printer and the direct printing method using the thermal transfer printer disclosed in JP-A-07-336466. JP-A-08-207263, and JP-A-11-157139 are effective when a large number of labels having the same shape are formed or when a label having a large size is formed. However, since methods of conveying an object to be printed to a printer are different when the size of an object to be printed is small (for example, clothes) or when a small quantity batch production of labels having different shapes is performed, the formation of the labels is troublesome.

Moreover, a method of thermally transferring an image onto an object to be printed after forming the image on a transfer sheet as in JP-A-05-077557 does not have the problems of the above-mentioned methods in that the shape of an object to be printed is not selected. However, since the size of the transfer sheet is fixed (for example, A4 or A3 is often used), the shapes to be transferred onto an object to be printed should be separately formed.

A method of JP-A-09-087980 is a method of forming a shape by using two transfer sheets and thermally transferring the shape onto an object to be printed, and is a method having solved these problems. However, it is troublesome in that two transfer sheets are used and a thermal transfer operation needs to be performed twice. Further, practically, the temperature, pressing pressure, and the like at the time of transfer of each sample to be formed are different, and skill is required for the work.

SUMMARY

The invention has been made in consideration of the above-mentioned circumstances, and an object of the invention is to provide an apparatus and method for forming a thermal transfer printing sheet that can bond a label resin to an object to be printed without using an adhesive, a thermal transfer printing sheet, and a thermal transfer printing method.

DETAILED DESCRIPTION

Figure 1:
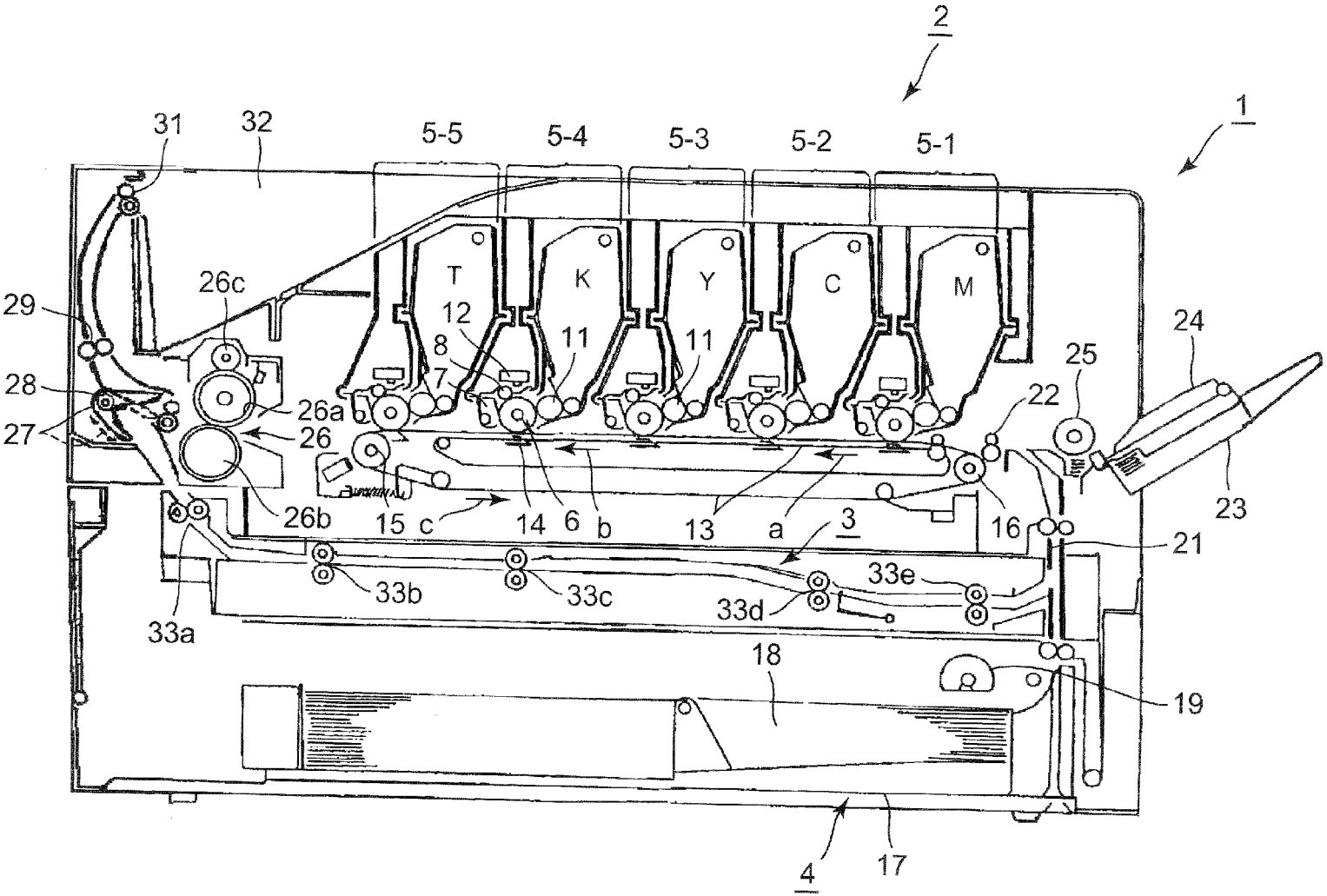
FIG. 1 is a cross-sectional view showing the internal structure of an apparatus for forming a thermal transfer printing sheet by methods of forming a thermal transfer printing sheet according to first to sixth embodiments of the invention.

Embodiments of the invention will be described in detail below with reference to the drawings. Meanwhile, in the following description, a release sheet feeder includes, for example, a sheet feeding cassette 17, an MPF (Multi Paper Feeder) tray 24, and the like; a first developing section includes, for example, image forming units 5-1, 5-2, 5-3, and 5-4, and the like; a first transfer section includes, for example, the image forming units 5-1, 5-2, 5-3, and 5-4, a conveying belt 13, transfer units 14, and the like; a second developing section includes, for example, an image forming unit 5-5, and the like; a second transfer section includes, for example, the image forming unit 5-5, the conveying belt 13, the transfer units 14, and the like; a fixing section includes, for example, a fixing unit 26, and the like; and a re-conveying section includes, for example, a re-conveying unit 3, and the like.

FIG. 1 is a cross-sectional view showing the internal structure of an apparatus for forming a thermal transfer printing sheet by methods of forming a thermal transfer printing sheet according to first to sixth embodiments of the invention. As shown in FIG. 1, the apparatus 1 for forming a thermal transfer printing sheet includes an image forming section 2, a re-conveying unit 3, and a sheet feeder 4.

The image forming section 2 has a structure where five image forming units 5 (5-1, 5-2, 5-3, 5-4, and 5-5) are arranged side by side in multiple stages.

Among the five image forming units 5, three image forming units 5-1, 5-2, and 5-3 positioned on the upstream side (the right side in FIG. 1) in a sheet conveying direction form, monochrome color images with color toners corresponding to magenta (M), cyan (C), and yellow (Y) that are three primary colors of subtractive color mixture, respectively.

The fourth image forming unit 5-4 successive to the three image forming units 5-1, 5-2, and 5-3 forms a monochrome image corresponding to black (K). These toner images corresponding to the four colors form a full-color image by superimposed on a release sheet (hereinafter, referred to as a sheet) to be described below.

Further, among the five image forming units 5, the image forming unit 5-5, which is positioned on the most downstream side (the left end in FIG. 1) in the sheet conveying direction, forms a toner image forming a transfer base material (T) made of a thermoplastic resin to be described in detail below (here, a toner image developed on a photoreceptor drum to be described below is referred to as an image regardless of a shape).

The respective image forming units 5-1 to 5-5 have the same structure except for the colors or kinds of developers stored in developing units thereof. Accordingly, this structure will be described below with reference to the image forming unit 5-4 as an example.

The image forming unit 5 includes a photoreceptor drum 6, a cleaner 7 that is disposed along the peripheral surface of the photoreceptor drum 6, a charging roller 8, a developing unit 9, and a developing roller 11 that is assembled in an opening of the lower surface of the developing unit 9.

An optical writing head 12 of a main body device is disposed close to the upper surface of the photoreceptor drum 6 positioned between the charging roller 8 and the developing unit 9. Further, a conveying belt 13 is provided close to the lower surface of the photoreceptor drum 6. Furthermore, a transfer unit 14 is pressed against the lower surface of the photoreceptor drum 6 with the conveying belt 13 interposed therebetween.

The conveying belt 13 is formed of a conductive sheet-like member that is made of a resin containing conductive carbon or an ion conductive material. The conveying belt 13 is wound around a driving roller 15 and a driven roller 16, is driven by the driving roller 15, and is rotationally moved in a counter-clockwise direction shown by arrows a, b, and c of FIG. 1.

The photoreceptor drum 6 is rotated in a clockwise direction in FIG. 1. First, the peripheral surface of the photoreceptor drum 6 is initialized by being uniformly charged with electric charge applied from the charging roller 8. Then, an electrostatic latent image is formed on the peripheral surface of the photoreceptor drum 6 by the optical writing of the optical writing head 12 based on printing information.

Further, the electrostatic latent image is changed into a toner image (developed) with the toner, which is stored in the developing unit 9, by being developing by the developing roller 11. The toner image developed on the peripheral surface of the photoreceptor drum 6 is rotated and conveyed to a transfer portion, where the photoreceptor drum 6 and the transfer unit 14 face each other, with the rotation of the photoreceptor drum 6.

Meanwhile, a plurality of cut sheet-like release sheets 18 is stored in the sheet feeding cassette 17 of the sheet feeder 4. The release sheets 18 are carried out from the sheet feeding cassette 17 one by one by one rotation of a sheet feeding roller 19, and are fed to a pair of standby rollers 22 through a conveying guide path 21.

Alternatively, when the number of thermal transfer printing sheets to be formed is small, the release sheets 18 are fed to the pair of standby rollers 22 by a sheet feeding roller 25 from the upper surface of the MPF tray 24 that is mounted on an opened mounting portion 23.

The pair of standby rollers 22 feeds the release sheet 18 onto the conveying belt 13 in timing when the print start position of the release sheet 18 corresponds to the end of the toner image of the photoreceptor drum 6 of the image forming unit 5-1 positioned on the most upstream side in the sheet conveying direction.

The release sheet 18 is conveyed while being electrostatically attracted to the upper surface of the conveying belt 13 that is rotationally moved. Accordingly, the release sheet 18 is moved together with the conveying belt 13 immediately below the photoreceptor drum 6 from the upstream side to the downstream side in the sheet conveying direction.

Further, a toner image corresponding to the first color is transferred onto the release sheet 18 at the transfer portion of the image forming unit 5-1, a toner image corresponding to the next color is transferred onto the release sheet 18 at the transfer portion of the image forming unit 5-2, a third toner image is transferred onto the release sheet 18 at the transfer portion of the mage forming unit 5-3, and a black toner image is transferred onto the release sheet 18 at the transfer portion of the image forming unit 5-4. Furthermore, a thermoplastic resin pattern forming a transfer base material (T), which is made of a thermoplastic resin, according to the invention (hereinafter, also referred to as a toner image) is transferred onto the release sheet 18 at the transfer portion of the image forming unit 5-5.

Moreover, the image forming units 5-1 to 5-4 are set to a printing state in the printing processing of a frill-color printing mode of this embodiment. Meanwhile, the image forming unit 5-5 is movable so as to be separated upward from a contact position, where the image forming unit 5-5 conies into contact with the conveying belt 13, according to a method of forming a thermal transfer printing sheet.

As described below, as the method of forming a thermal transfer printing sheet, a thermal transfer printing sheet may be formed by several procedures but there are two main methods. That is, in a first method, a toner image forming a transfer base material is superimposed on and transferred onto a release sheet 18, where toner images corresponding to four colors have been superimposed and transferred as described above, at the transfer portion of the image forming unit 5-5 and is carried into the fixing unit 26. Further, in a second method, after a release sheet 18, where toner images corresponding to four colors have been superimposed and transferred as described above, is carried into the fixing unit 26 once as it is and is subjected to fixing, the release sheet 18 returns to the conveying belt 13 again through the re-conveying unit 3, a toner image forming a transfer base material is superimposed on and transferred onto the release sheet 18 at the transfer portion of the image forming unit 5-5, and the release sheet 18 is then carried into the fixing unit 26. Meanwhile, the fixing unit 26 includes a heat roller 26*a*, a pressing roller 26*b*, and a cleaner 26*c*.

In any event, while the release sheet 18 is interposed between the heat roller 26*a* and the pressing roller 26*b* and conveyed, the toner image is fixed to the release sheet 18 by being melted and pressure-bonded to the surface of the release sheet 18 by heat and pressure. Further, the cleaner 26*c* removes the toner remaining on the heat roller 26*a*.

A switching plate 27 is turned downward as shown by a broken line of FIG. 1, so that the release sheet 18, to which a full-color toner image and the transfer base material have been fixed by the fixing unit 26 as described above, is conveyed upward by conveying rollers 29. Then, the release sheet 18 is discharged to a sheet discharge section 32 by a sheet discharge roller 31 so that the surface of the release sheet 18 on which an image is formed faces downward. Meanwhile, the release sheet 18, onto which the toner images corresponding to four colors have been transferred and which has been carried into the fixing unit 26 once as it is, is fed to the re-conveying unit 3 for reprint when the switching plate 27 is turned upward as shown by a solid line of FIG. 1.

Here, a plurality of conveying rollers 33*a* to 33*e* is provided in the re-conveying unit 3. Theo-conveying unit 3 feeds a sheet to the conveying guide path 21 again so that the sheet can be overprinted through the temporary stop of the conveyance of the sheet and the conveyance of the sheet using the plurality of conveying rollers 33*a* to 33*e*.

In this embodiment (fourth to sixth embodiments), the release sheet 18 to which a full-color toner image has been fixed is fed to the re-conveying unit 3 as it is when the switching plate 27 is turned upward as shown by the solid line of FIG. 1.

In this case, the pair of standby rollers 22 feeds the sheet onto the conveying belt 1 in timing when the print position of the toner image, which forms the transfer base material, of the release sheet 18 corresponds to the end of the toner image of the photoreceptor drum 6 of the image forming unit 5-5 positioned on the most downstream side in the sheet conveying direction.

When the toner image forming the transfer base material is transferred and developed by the image forming unit 5-5, the conveying belt 13 is separated downward from the image forming units 5-1 to 5-4. Further, the image forming unit 5-5, which is in charge of the printing of the toner image forming the transfer base material, is moved downward from a retreat position that is set to the upper side, so that the photoreceptor drum 6 of the image forming unit 5-5 comes into contact with the conveying belt 13.

The printing of the toner image forming the transfer base material, which is to be performed after that on the release sheet 18 on which the image has been formed, is substantially the same as the above-mentioned formation of the images using color toners. However, the printing of the toner image forming the transfer base material is slightly different from the image formation using color toners in that the image printed using the toner image forming the transfer base material corresponds to solid printing and the solid printing of the toner image forming the transfer base material is performed on the fixed other toner images in a predetermined shape.

The release sheet 18 on which the solid printing of the toner image forming the transfer base material has been performed is carried into the fixing unit 26 again, and the image forming the transfer base material subjected to solid printing is fixed to the surface of the release sheet 18.

Further, the switching plate 27 is configured to guide the release sheet 18 to the upper side, so that the release sheet 18 is conveyed to the upper side of the conveying rollers 29. Then, the release sheet 18 is discharged to the sheet discharge section 32 by the sheet discharge roller 31 so that the surface of the release sheet 18 on which an image is formed faces downward.

Here, a control section, which drives and controls the respective sections of the apparatus 1 for forming a thermal transfer printing sheet as described above and controls the processing for superimposing and forming the color images and the toner image forming the transfer base material on the release sheet 18 as described below, will be described.

Figure 2:
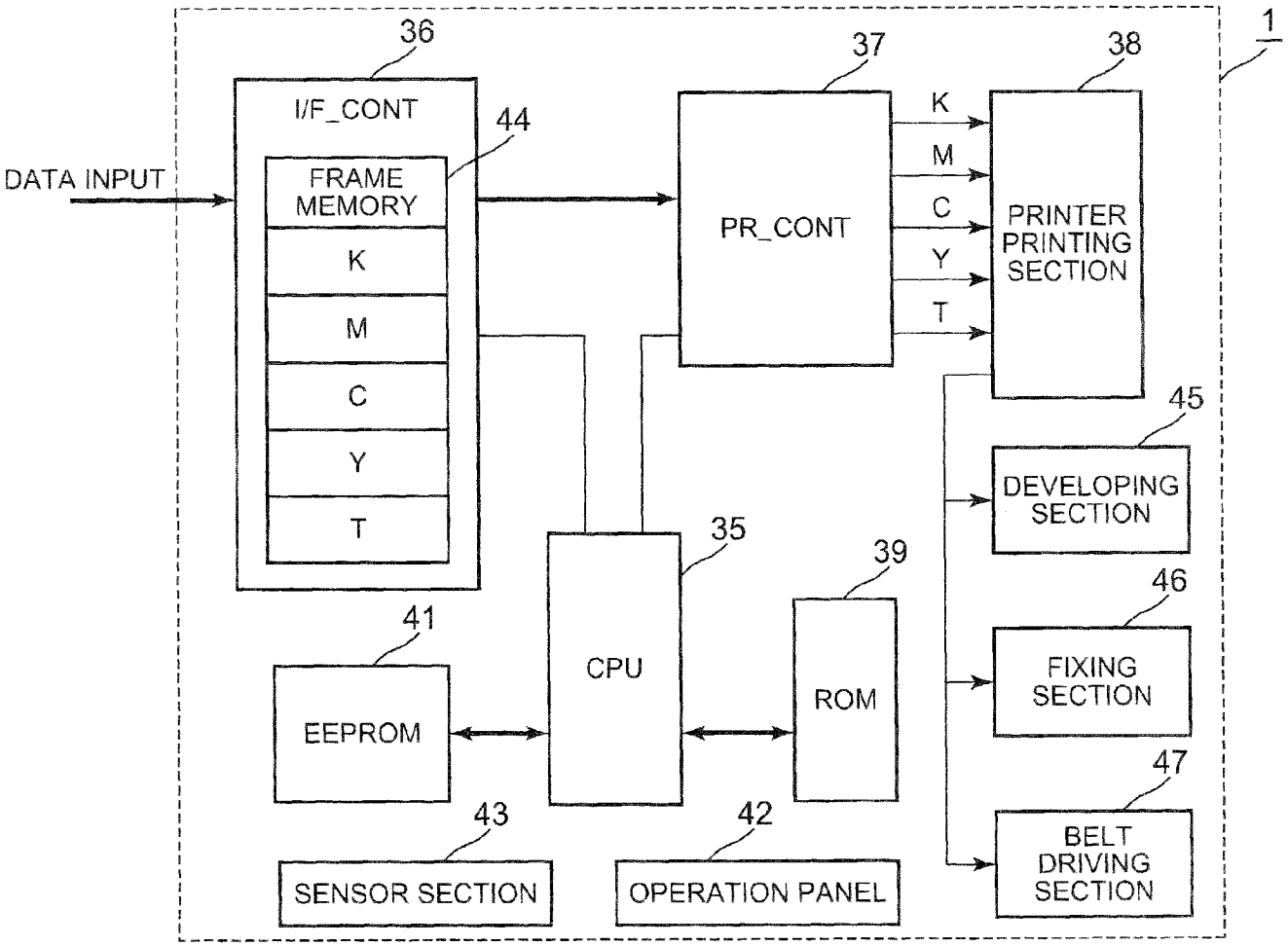
FIG. 2 is a circuit block diagram including control devices of apparatuses for forming a thermal transfer printing sheet according to the first to sixth embodiments of the invention.

FIG. 2 is a circuit block diagram including a control device of the apparatus 1 for forming a thermal transfer printing sheet. As shown in FIG. 2, in a circuit block, a CPU (central processing unit) 35 serves as a main component and an interface (I/F) controller 36 and a printer controller 37 are connected to the CPU 35 through data buses. A printer printing section 38 is connected to the printer controller 37.

Moreover, a ROM (read only memory) 39, an EEPROM (electrically erasable programmable ROM) 41, an operation panel 42 of a main body operating section, and a sensor section 43 to which outputs of sensors disposed on the respective sections are input are connected to the CPU 35.

A system program is stored in the ROM 39, and the CPU 35 performs processing by controlling the respective sections according to the system program.

That is, in the respective sections, first, the interface controller 36 converts the printing data, which are supplied from a host device such as a personal computer, into bit-map data and develops the bit-map data in a frame memory 44.

Since the memory area of the frame memory 44 is set for each of black (K), magenta (M), cyan (C), yellow (Y), and the transfer base material (T), the data of the respective colors and the transfer base material are developed in the corresponding areas.

The data developed in the frame memory 44 are output to the printer controller 37, and are output to the printer printing section 38 from the printer controller 37.

The printer printing section 38 is an engine section. The printer printing section 38 includes a driving section (not shown) that drives the upward and downward movement of a rotational drive system (not shown) including photoreceptor drum 6 shown in FIG. 1 and the like, an image forming section including a driven section, such as the charging roller 8 and the optical writing head 12, and the conveying belt 13, under the control from the printer controller 37.

Further, the printer printing section 38 supplies the respective color image data, which correspond to black (K), magenta (M), cyan (C), and yellow (Y), to the respective corresponding optical writing heads 12 shown in FIG. 1.

Furthermore, the printer printing section 38 controls the formation of electrostatic latent images on the photoreceptor drums 6 and the development, which uses the toner of the transfer base material or the respective colors corresponding to the formed electrostatic latent images, through the developing section 45 on the basis of the image data of the optical writing heads 12.

Moreover, the printer printing section 38 controls drive outputs for performing various controls, such as the adjustment of a voltage applied to a heat generator built in the heat roller 26*a* of the fixing unit 26 and a force applied by the pressing roller 26*b* pressing the heat roller 26*a*, through the fixing section 46.

In addition, the printer printing section 38 controls a drive output for performing the upward and downward movement of a belt position control mechanism of the conveying belt 13, the rotational drive of the driving roller 15 rotationally moving the conveying belt 13, or the like through a belt driving section 47.

[First Embodiment]

Figure 3A:
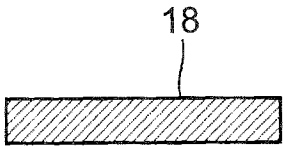
FIGS. 3A to 3D are views schematically showing steps of forming a thermal transfer printing sheet according to a first embodiment that is formed by the apparatus 1, which has the structure, for forming a thermal transfer printing sheet.
Figure 3B:
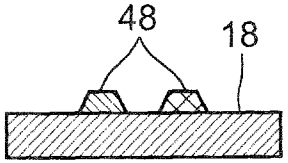
Figure 3C:
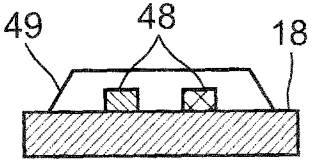
Figure 3D:
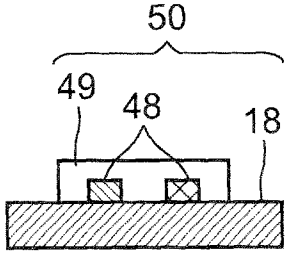
Figure 3E:
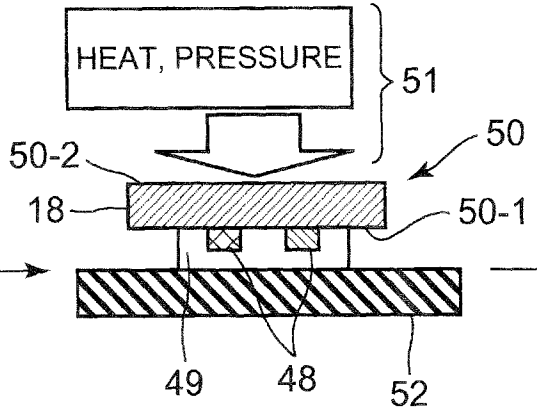
FIGS. 3E and 3F are views showing a procedure and steps of transferring a label image of the thermal transfer printing sheet onto a transfer medium.
Figure 3F:
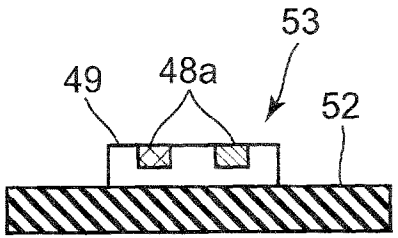

FIGS. 3A to 3D are views schematically showing steps of forming a thermal transfer printing sheet according to a first embodiment that is formed by the apparatus 1, which has the structure, for forming a thermal transfer printing sheet, and FIGS. 3E and 3F are views showing a procedure and steps of transferring a label image of the thermal transfer printing sheet onto a transfer medium.

FIG. 3A shows a first step. FIG. 3A shows a transparent (which is shown in FIG. 3A by hatching so as to be distinguished from the transfer base material of a post-step) release sheet 18 that is stored in the sheet feeding cassette 17 or placed on the MPF tray 24 and sent to the conveying belt 13 by the sheet feeding roller 19 or 25 so that the release surface of the release sheet 18 faces upward.

FIG. 3B shows a second step. FIG. 3B shows a state where a normal image of an image to be thermally printed on a transfer medium is written at the image forming units 5-1, 5-2, 5-3, and 5-4 by the optical writing heads 12 and is developed and the developed normal image is transferred onto the release surface of the release sheet 18 as a mirror image 48.

FIG. 3C shows a third step. FIG. 3C shows a state where a film-like thermoplastic resin pattern 49 forming the transfer base material and developed in a film shape by the image forming unit 5-5 is superimposed on and transferred onto the release surface of the release sheet 18 so as to cover the mirror image 48.

FIG. 3D shows a fourth step and shows the state of a thermal transfer printing sheet 50. The release sheet 18 to which the film-like thermoplastic resin pattern 49 forming the transfer base material has been transferred so as to cover the mirror image 48 is carried into the fixing unit 26 and is interposed between the heat roller 26*a* and the pressing roller 26*b*. Then, the film-like thermoplastic resin pattern 49 is fixed in the thermal transfer printing sheet 50 by heat and pressure.

That is, the formation of the thermal transfer printing sheet 50, which includes the release sheet 18, the mirror image 48, and the film-like thermoplastic resin pattern 49 forming the transfer base material, is completed by the processing from the above-mentioned first step to the above-mentioned fourth step.

Subsequently, FIG. 3E shows a fifth step. In FIG. 3E, the thermal transfer printing sheet 50 is superimposed on a transfer medium 52 such as a T-shirt by using, for example, a heating press 51 generally sold for industrial use in a market so that a mirror image-formation surface (release surface) 50-1 faces the transfer medium 52.

Further, the thermal transfer printing sheet 50 is bonded to the transfer medium 52 with the film-like thermoplastic resin pattern 49, which forms the transfer base material, interposed therebetween by heat and pressure applied from a back surface 50-2 of the thermal transfer printing sheet 50 opposite to the mirror image-formation surface so that the release sheet 18 can be detached after cooling.

Meanwhile, the heating press 51 has been used in the above-mentioned embodiment. However, since the heating press 51 is a large machine and expensive, the thermal transfer printing sheet 50 and the mirror image 48 may be bonded to the transfer medium 52 by manual ironing.

After that, when the thermal transfer printing sheet 50 is cooled to about room temperature and the release sheet 18 is manually detached, the transfer printing of an image label 53, which has been changed into a normal image 48*a* from the mirror image 48, is completely formed on the transfer medium 52, which is an object to be printed such as a T-shirt, as shown in FIG. 3F.

Meanwhile, since the film-like thermoplastic resin pattern 49 as the transfer base material of the image label 53 is formed to be transparent in the case of this embodiment, the image of the image label 53 shows up on the background when the film-like thermoplastic resin pattern 49 is transferred and printed on another white or light-colored T-shirt or the like. Accordingly, this is preferable.

Further, if the transfer medium 52 is deep-colored clothes, such as dark blue clothes or black clothes, titanium oxide is added to a toner material when the toner of a transfer base material is formed. The transfer base material to which titanium oxide has been added has an opaque white color.

Accordingly, it is possible to form the thermal transfer printing sheet 50 where an image is formed on an opaque white label. When this thermal transfer printing sheet 50 is transferred and printed on deep-colored clothes, a shape where a label on which an image is formed is transferred and printed on a white background is formed. Therefore, even though the transfer medium 52 is deep-colored clothes, the appearance of the image becomes good.

[Second Embodiment]

Figure 4A:
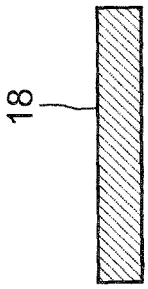
FIGS. 4A to 4D are views schematically showing steps of forming a thermal transfer printing sheet according to a second embodiment that is formed by the apparatus 1, which has the structure, for forming a thermal transfer printing sheet.
Figure 4B:
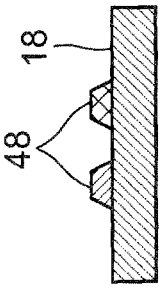
Figure 4C:
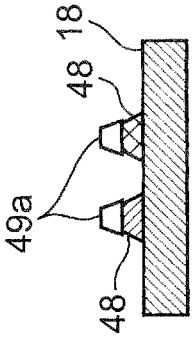
Figure 4D:
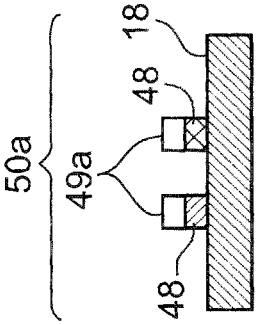
Figure 4E:
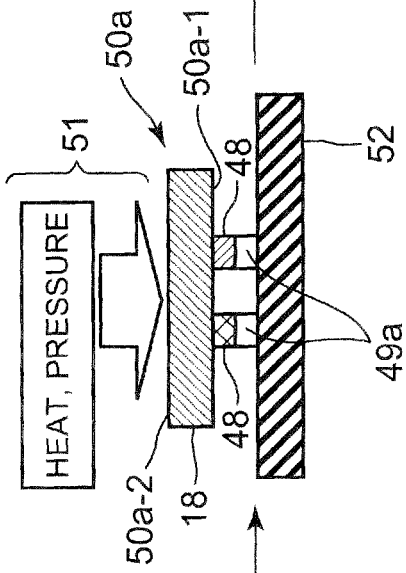
FIGS. 4E and 4F are views showing a procedure and steps of transferring an image of the thermal transfer printing sheet onto a transfer medium.
Figure 4F:
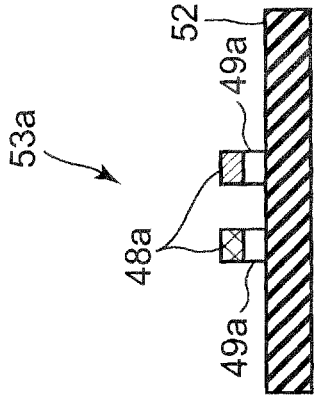

FIGS. 4A to 4D are views schematically showing steps of forming a thermal transfer printing sheet according to a second embodiment that is formed by the apparatus 1 for forming a thermal transfer printing sheet shown in FIG. 1, and FIGS. 4E and 4F are views showing a procedure and steps of transferring an image of the thermal transfer printing sheet onto a transfer medium.

Meanwhile, in FIGS. 4A to 4F, the same members as the members shown in FIGS. 3A to 3F are denoted by the same reference numerals as the reference numerals shown in FIGS. 3A to 3F. Further, a first step shown in FIG. 4A and a second step shown in FIG. 4B are the same as the first step shown in FIG. 3A and the second step shown in FIG. 3B.

A third step shown in FIG. 4C is different from the third step shown in FIG. 3C in that a mirror image 49*a* of a thermoplastic resin pattern, which forms a transfer base material and is developed in the same shape as a normal image of an image to be transmitted and printed on a transfer medium by the image forming unit 5-5, is superimposed and transferred onto a mirror image 48.

FIG. 4D shows a fourth step and shows the state of a thermal transfer printing sheet 50*a*. The release sheet 18 where the mirror image 49*a* of the thermoplastic resin pattern, which forms the transfer base material and has the same shape as the mirror image 48, has been superimposed and transferred onto the mirror image 48 is carried into the fixing unit 26 and is interposed between the heat roller 26*a* and the pressing roller 26*b*. Then, the thermoplastic resin pattern 49*a* is fixed in the thermal transfer printing sheet 50*a* by heat and pressure.

That is, the formation of the thermal transfer printing sheet 50*a*, which includes the release sheet 18, the mirror image 48, and the mirror image 49*a* of the thermoplastic resin pattern forming the transfer base material and having the same shape as the mirror image 48, is completed by the processing from the above-mentioned first step to the above-mentioned fourth step.

Subsequently, FIG. 4E shows a fifth step. In FIG. 4E, the thermal transfer printing sheet 50*a* is superimposed on a transfer medium 52 such as a T-shirt by using, for example, a heating press 51 sold in a market so that a mirror image-formation surface 50*a*-1 faces the transfer medium 52.

Further, the thermal transfer printing sheet 50*a* is bonded to the transfer medium 52 with the thermoplastic resin pattern 49*a*, which has the same shape as the mirror image 48, interposed therebetween by heat and pressure applied from a back surface 50*a*-2 of the thermal transfer printing sheets 50*a* opposite to the mirror image-formation surface so that the release sheet 18 can be detached after cooling.

Meanwhile, even in the case of this embodiment, the thermal transfer printing sheet 50*a* and the mirror image 48 may be bonded to the transfer medium 52 with the thermoplastic resin pattern 49*a* interposed therebetween by manual ironing without the use of the heating press 51.

After that, when the thermal transfer printing sheet 50*a* is cooled to about room temperature and the release sheet 18 is manually detached, a transfer image 53*a*, which has been changed into a normal image 48*a* from the mirror image 48, is completely formed on the transfer medium 52, which is an object to be printed such as a T-shirt, as shown in FIG. 4F.

[Third Embodiment]

In the above-mentioned first and second embodiments, the image forming section 2 of the apparatus 1 for forming a thermal transfer printing sheet of FIG. 1 has been described using the example where the four image forming units 5 (5-1, 5-2, 5-3, and 5-4) for toners corresponding to magenta (M), cyan (C), yellow (Y), and black (K) positioned in this order from the upstream side (the right side in FIG. 1) in the sheet conveying direction and the image forming unit 5-5 for the transfer base material (T) forming a thermoplastic resin positioned on the most downstream side (the left end in FIG. 1) are arranged side by side in multiple stages. However, the positions of these image forming units 5 (5-1, 5-2, 5-3, 5-4, and 5-5) may be changed.

For example, the image forming unit 5-5 may be positioned on the most upstream side in the sheet conveying direction, that is, the position of the image forming unit 5-5 may be exchanged for the position of the image forming unit 5-1 for magenta (M) in FIG. 1. Further, the four image forming units 5 (5-1, 5-2, 5-3, and 5-4) may be disposed so as to be shifted to the downstream side, respectively.

A procedure for forming the thermal transfer printing sheet of the invention in this case will be described below as a third embodiment.

Figures 5A, 5B, 5C, 5D, 5E, 5F:
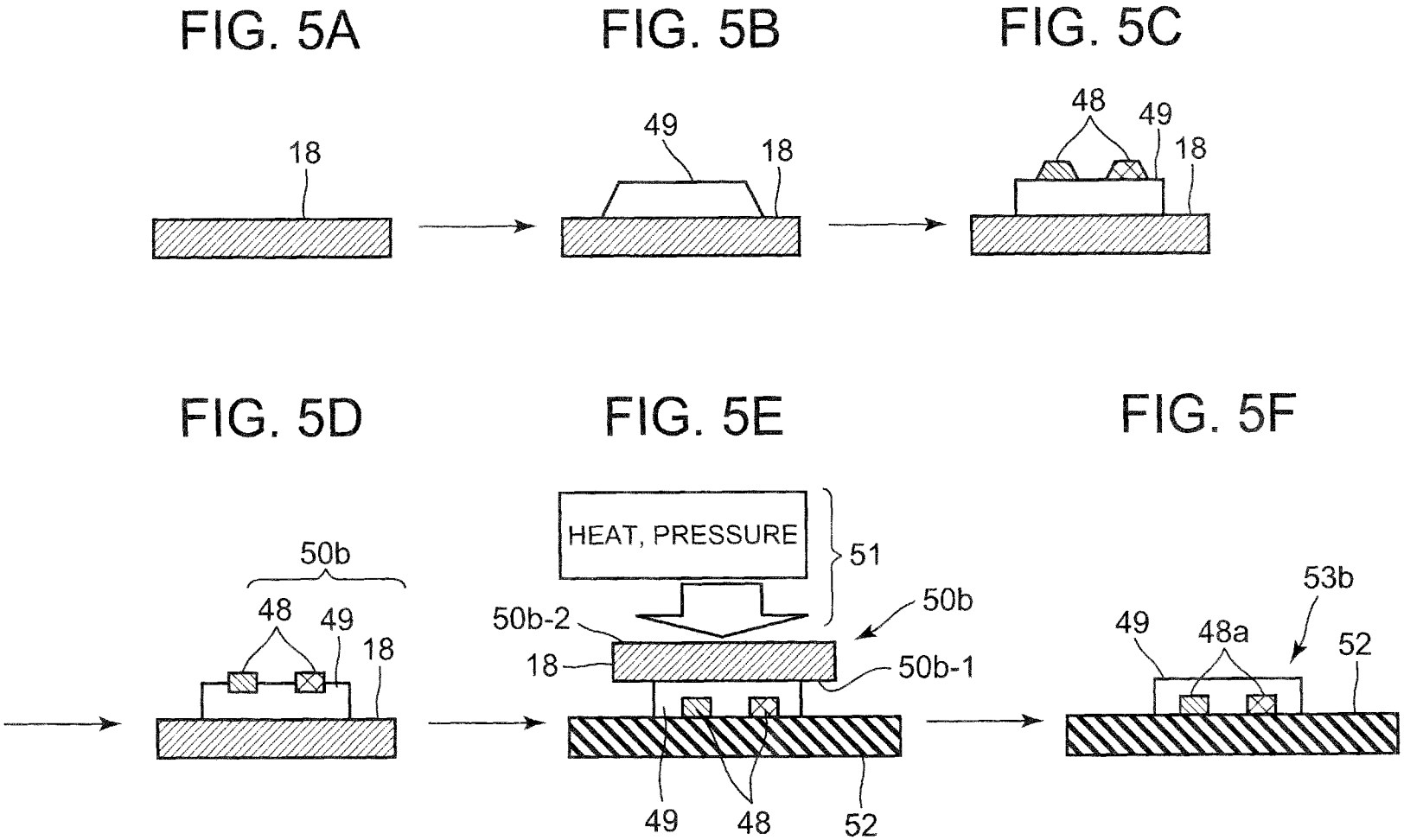
FIGS. 5A to 5D are views schematically showing steps of forming a thermal transfer printing sheet according to a third embodiment that is formed by the apparatus 1, which has the structure, for forming a thermal transfer printing sheet.
FIGS. 5E and 5F are views showing a procedure and steps of transferring an image of the thermal transfer printing sheet onto a transfer medium.

FIGS. 5A to 5D are views schematically showing steps of forming a thermal transfer printing sheet of a third embodiment when the image forming unit 5 of the apparatus 1 for forming a thermal transfer printing sheet of FIG. 1 is exchanged, and FIGS. 5E and 5F are views showing a procedure and steps of transferring an image of the thermal transfer printing sheet onto a transfer medium.

Meanwhile, in FIGS. 5A to 5F, the same members as the members shown in FIGS. 3A to 3F and FIGS. 4A to 4F are denoted by the same reference numerals as the reference numerals shown in FIGS. 3A to 3F and FIGS. 4A to 4F. Further, a first step shown in FIG. 5A is the same as the first steps shown in FIGS. 3A and 4A.

FIG. 5B shows a second step, and shows a state where a thermoplastic resin pattern 49 developed in a film shape by the image forming unit 5-5 disposed on the most upstream side is transferred onto the release surface of the release sheet 18.

FIG. 5C shows a third step, and shows a state where a mirror image 48 of an image to be transferred and printed onto a transfer medium is transferred onto a film-like thermoplastic resin pattern 49 transferred onto the release surface of the release sheet 18.

FIG. 5D shows a fourth step and shows the state of a thermal transfer printing sheet 50*b*. The release sheet 18 where a mirror image 48 has been transferred onto the film-like thermoplastic resin pattern 49 forming a transfer base material is carried into the fixing unit 26 and is interposed between the heat roller 26*a* and the pressing roller 26*b*. Then, the mirror image 48 is fixed in the thermal transfer printing sheet 50*b* by heat and pressure.

That is, the formation of the thermal transfer printing sheet 50*b*, which includes the release sheet 18, the mirror image 48, and the film-like thermoplastic resin pattern 49 forming the transfer base material, is completed by the processing from the above-mentioned first step to the above-mentioned fourth step.

Subsequently, FIG. 5E shows a fifth step. In FIG. 5E, the thermal transfer printing sheet 50*b* is superimposed on a transfer medium 52 such as a T-shirt by using, for example, a heating press 51 generally sold for industrial use in a market so that a mirror image-formation surface 50*b*-1 faces the transfer medium 52.

Further, the thermal transfer printing sheet 50*b* is bonded to the transfer medium 52 with the film-like thermoplastic resin pattern 49, which forms the transfer base material, interposed therebetween by heat and pressure applied from a back surface 50*b*-2 of the thermal transfer printing sheet 50*b* opposite to the mirror image-formation surface so that the release sheet 18 can be detached after cooling.

Meanwhile, the heating press 51 has been used in the above-mentioned embodiment. However, since the heating press 51 is a large machine and expensive, the thermal transfer printing sheet 50*b* and the mirror image 48 may be bonded to the transfer medium 52 by manual ironing.

After that, when the thermal transfer printing sheet 50*b* is cooled to about room temperature and the release sheet 18 is manually detached, the transfer printing of an image label 53*b*, which has been changed into a normal image 48*a* from the mirror image 48, is completely formed on the transfer medium 52, which is an object to be printed such as a T-shirt, as shown in FIG. 5F.

[Fourth Embodiment]

Figure 6A:
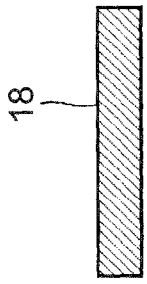
FIGS. 6A to 6E are views schematically showing steps of forming a thermal transfer printing sheet according to a fourth embodiment that is formed by the apparatus which has the structure, for forming a thermal transfer printing sheet.
Figure 6B:
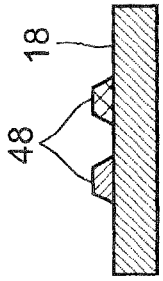
Figure 6C:
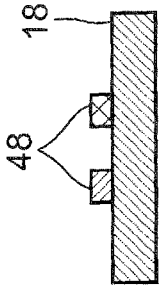
Figure 6D:
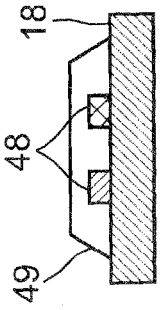
Figure 6E:
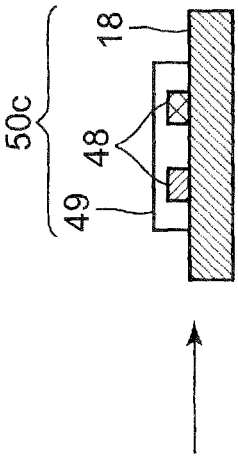
Figure 6F:
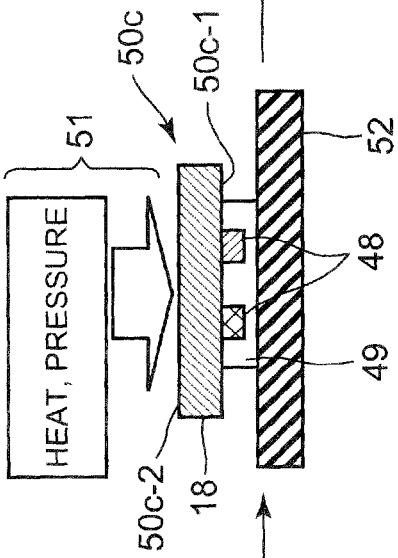
FIGS. 6F and 6G are views showing a procedure and steps of transferring a label image of the thermal transfer printing sheet onto a transfer medium.
Figure 6G:
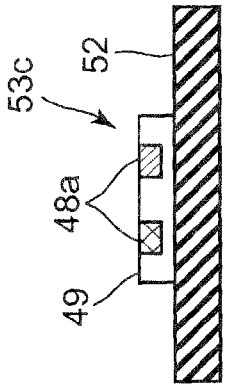

FIGS. 6A to 6E are views schematically showing steps of forming a thermal transfer printing sheet according to a fourth embodiment that is formed by the apparatus 1, which has the structure, for forming a thermal transfer printing sheet, and FIGS. 6F and 6G are views showing a procedure and steps of transferring a label image of the thermal transfer printing sheet onto a transfer medium.

Meanwhile, in FIGS. 6A to 6G, the same members as the members shown in FIGS. 3A to 3F and FIGS. 4A to 4F are denoted by the same reference numerals. Further, first and second steps shown in FIGS. 6A and 6B are the same as the respective first and second steps shown in FIGS. 3A and 3B and FIGS. 4A and 4B. Accordingly, the description of the first and second steps shown in FIGS. 6A and 6B will be omitted.

FIG. 6C shows a third step, and shows a state where a release sheet 18 onto which a mirror image 48 has been transferred is carried into the fixing unit 26 and is interposed between the heat roller 26*a* and the pressing roller 26*b* and the mirror image 48 is preliminarily fixed to the release surface of the release sheet 18.

FIG. 6D shows a fourth step, and shows a state where the release sheet 18 to which the mirror image 48 has been fixed is fed onto the conveying belt 13 again through the re-conveying unit 3 and a thermoplastic resin pattern 49 forming a transfer base material and developed in a film shape by the image forming unit 5-5 is transferred so as to cover the mirror image 48.

FIG. 6E shows a fifth step and shows the state of a thermal transfer printing sheet 50*c*. The release sheet 18 where the film-like thermoplastic resin pattern 49 forming a transfer base material has been transferred so as to cover the mirror image 48 is carried into the fixing unit 26 and is interposed between the heat roller 26*a* and the pressing roller 26*b*. Then, the film-like thermoplastic resin pattern 49 is fixed in the thermal transfer printing sheet 50*c* by heat and pressure.

That is, the formation of the thermal transfer printing sheet 50*c*, which includes the release sheet 18, the mirror image 48, and the film-like thermoplastic resin pattern 49 forming the transfer base material, is completed by the processing from the above-mentioned first step to the above-mentioned fifth step.

Subsequently, FIG. 6F shows a sixth step. In FIG. 6F, as described above, the thermal transfer printing sheet 50*c* is superimposed on a transfer medium 52 such as a T-shirt by using, for example, a heating press 51 generally sold for industrial use in a market so that a mirror image-formation surface 50*c*-1 faces the transfer medium 52.

Further, the thermal transfer printing sheet 50*c* is bonded to the transfer medium 52 with the film-like thermoplastic resin pattern 49, which forms the transfer base material, interposed therebetween by heat and pressure applied from a back surface 50*c*-2 of the thermal transfer printing sheet 50*c* opposite to the mirror image-formation surface so that the release sheet 18 can be detached after cooling.

Meanwhile, the heating press 51 has been used even in the above-mentioned embodiment. However, since the heating press 51 is a large machine and expensive, the thermal transfer printing sheet 50*c* and the mirror image 48 may be bonded to the transfer medium 52 by manual ironing.

After that, when the thermal transfer printing sheet 50*c* is cooled to about room temperature and the release sheet 18 is manually detached, the transfer printing of an image label 53*c*, which has been changed into a normal image 48*a* from the mirror image 48, is completely formed on the transfer medium 52, which is an object to be printed such as a T-shirt, as shown in FIG. 6G.

Meanwhile, since the film-like thermoplastic resin pattern 49 as the transfer base material of the image label 53*c* is formed to be transparent even in the case of this embodiment, the image of the image label 53 shows up on the background when the film-like thermoplastic resin pattern 49 is transferred and printed on another white or light-colored T-shirt or the like. Accordingly, this is preferable.

Further, if the transfer medium 52 is deep-colored clothes, such as dark blue clothes or black clothes, titanium oxide is added to a toner material when the toner of a transfer base material is formed. The transfer base material to which titanium oxide has been added has an opaque white color.

Accordingly, it is possible to form the thermal transfer printing sheet 50*c* where an image is formed on an opaque white label. When this thermal transfer printing sheet 50*c* is transferred and printed on deep-colored clothes, a shape where a label on which an image is formed is transferred and printed on a white background is formed. Therefore, even though the transfer medium 52 is deep-colored clothes, the appearance of the image becomes good.

[Fifth Embodiment]

Figures 7A, 7B, 7C, 7D, 7E, 7F, 7G:
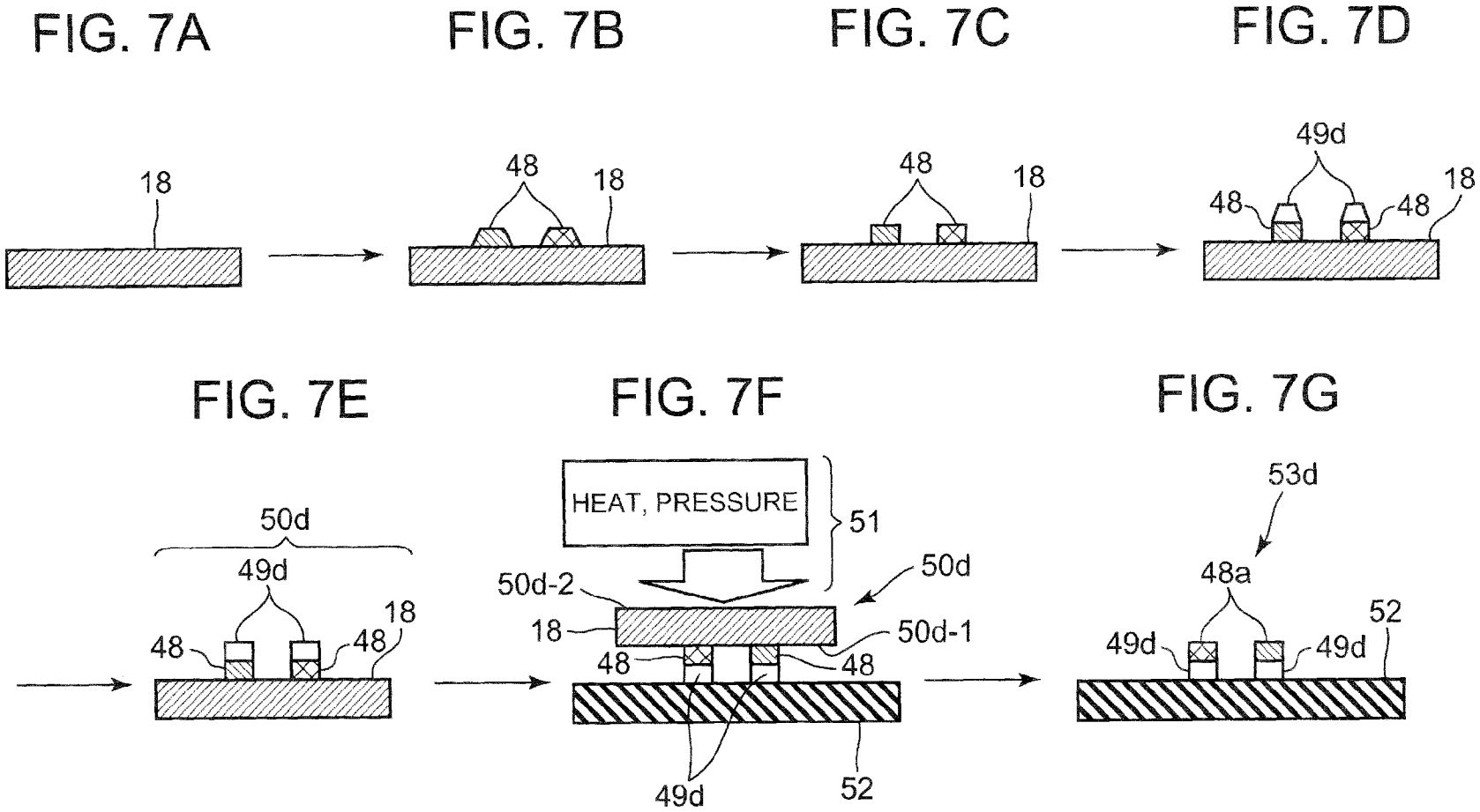
FIGS. 7A to 7E are views schematically showing steps of forming a thermal transfer printing sheet according to a fifth embodiment that is formed by the apparatus 1, which has the structure, for forming a thermal transfer printing sheet.
FIGS. 7F and 7G are views showing a procedure and steps of transferring an image of the thermal transfer printing sheet onto a transfer medium.

FIGS. 7A to 7E are views schematically showing steps of forming a thermal transfer printing sheet according to a fifth embodiment that is formed by the apparatus 1 for forming a thermal transfer printing sheet of FIG. 1, and FIGS. 7F and 7G are views showing a procedure and steps of transferring an image of the thermal transfer printing sheet onto a transfer medium.

Meanwhile, in FIGS. 7A to 7G, the same members as the members shown in FIGS. 6A to 6G are denoted by the same reference numerals as the reference numerals shown in FIGS. 6A to 6G. Further, first to third steps shown in FIGS. 7A to 7C are the same as the first to third steps shown in FIGS. 6A to 6C. Accordingly, the description of the first to third steps shown in FIGS. 7A to 7C will be omitted.

In a fourth step shown in FIG. 7D, the same steps as the steps previous to the fourth step of FIG. 6D are performed until the release sheet 18 to which the mirror image 48 of the previous step has been fixed is fed onto the conveying belt 13 again through the re-conveying unit 3.

In this embodiment, in the later stage of the fourth step, a thermoplastic resin pattern 49*d*, which forms a transfer base material and is developed in the same shape as the mirror image 48 by the image forming unit 5-5, is superimposed and transferred onto the mirror image 48 as shown in FIG. 7D.

FIG. 7E shows a fifth step and shows the state of a thermal transfer printing sheet 50*d*. The release sheet 18 where the thermoplastic resin pattern 49*d* forming the transfer base material and having the same shape as the mirror image 48 has been superimposed and transferred onto the mirror image 48 is carried into the fixing unit 26 and is interposed between the heat roller 26*a* and the pressing roller 26*b*. Then, the thermoplastic resin pattern 49*d* is fixed in the thermal transfer printing sheet 50*d* by heat and pressure.

That is, the formation of the thermal transfer printing sheet 50*d*, which includes the release sheet 18, the mirror image 48, and the thermoplastic resin pattern 49*d* forming the transfer base material and having the same shape as the mirror image 48, is completed by the processing from the above-mentioned first step to the above-mentioned fifth step.

Subsequently, FIG. 7F shows a sixth step. In FIG. 7F, the thermal transfer printing sheet 50*d* is superimposed on a transfer medium 52 such as a T-shirt by using, for example, a heating press 51 sold in a market as described above so that a mirror image-formation surface 50*d*-1 faces the transfer medium 52.

Further, the thermal transfer printing sheet 50*d* is bonded to the transfer medium 52 with the thermoplastic resin pattern 49*d*, which has the same shape as the mirror image 48, interposed therebetween by heat and pressure applied from a hack surface 50*d*-2 of the thermal transfer printing sheet 50*d* opposite to the mirror image-formation surface so that the release sheet 18 can be detached after cooling.

Meanwhile, even in the case of this embodiment, the thermal transfer printing sheet 50*d* and the mirror image 48 may be bonded to the transfer medium 52 with the thermoplastic resin pattern 49*d* interposed therebetween by manual ironing without the use of the heating press 51.

After that, when the thermal transfer printing sheet 50*d* is cooled to about room temperature and the release sheet 18 is manually detached, a transfer image 53*d*, which has been changed into a normal image 48*a* from the mirror image 48, is completely formed on the transfer medium 52, which is an object to be printed such as a T-shirt, as shown in FIG. 7G.

[Sixth Embodiment]

Figure 8A:
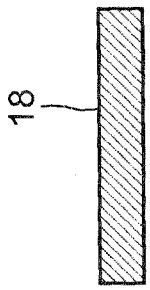
FIGS. 8A to 8E are views schematically showing steps of forming a thermal transfer printing sheet according to a sixth embodiment that is formed by the apparatus 1, which has the structure, for forming a thermal transfer printing sheet.
Figure 8B:
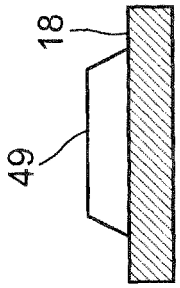
Figure 8C:
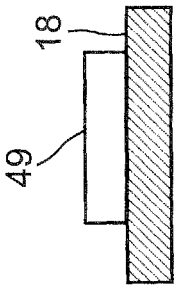
Figure 8D:
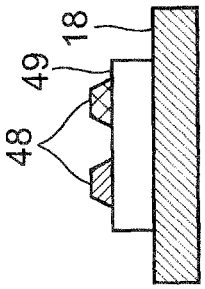
Figure 8E:
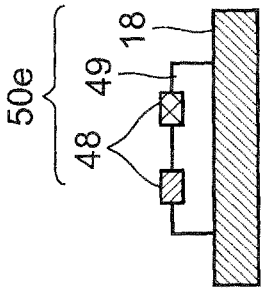
Figure 8F:
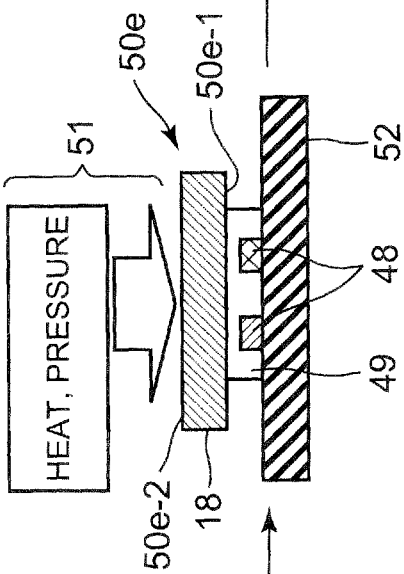
FIGS. 8F and 8G are views showing a procedure and steps of transferring a label image of the thermal transfer printing sheet onto a transfer medium.
Figure 8G:
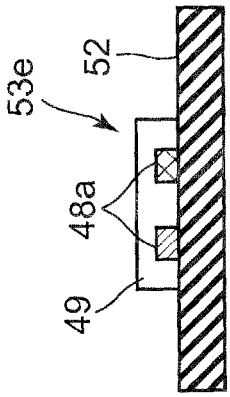

FIGS. 8A to 8E are views schematically showing steps of forming a thermal transfer printing sheet according to a sixth embodiment that is formed by the apparatus 1 for forming a thermal transfer printing sheet of FIG. 1, and FIGS. 8F and 8G are views showing a procedure and steps of transferring a label image of the thermal transfer printing sheet onto a transfer medium.

Meanwhile, in FIGS. 8A to 8G, the same members as the members shown in FIGS. 5A to 5F are denoted by the same reference numerals as the reference numerals shown in FIGS. 5A to 5F. Further, the processing of first and second steps shown in FIGS. 8A and 8B is the same as the processing of the first and second steps of the above-mentioned second embodiment.

FIG. 8C shows a third step, and shows a state where a release sheet 18 onto which a film-like thermoplastic resin pattern 49 forming a transfer base material has been transferred is carried into the fixing unit 26 and is interposed between the heat roller 26*a* and the pressing roller 26*b* and the film-like thermoplastic resin pattern 49 forming the transfer base material is fixed to the lease surface of the release sheet 18.

FIG. 8D shows a fourth step. In the fourth step, the release sheet 18 to which the film-like thermoplastic resin pattern 49 forming the transfer base material has been fixed is fed onto the conveying belt 13 again through the re-conveying unit 3.

Subsequently, a normal image of an image, which is to be printed on a transfer medium by transfer, is written at the image forming units 5-1, 5-2, 5-3, and 5-4 by the optical writing heads 12 and is developed and the developed normal image is transferred onto the film-like thermoplastic resin pattern 49 forming the transfer base material as a mirror image 48 as shown in FIG. 8D.

FIG. 8E shows a fifth step and shows the state of a thermal transfer printing sheet 50*e*. The release sheet 18 where a mirror image 48 has been transferred onto the film-like thermoplastic resin pattern 49 forming the transfer base material is carried into the fixing unit 26 and is interposed between the heat roller 26*a* and the pressing roller 26*b*. Then, the mirror image 48 is fixed in the thermal transfer printing sheet 50*e* by heat and pressure.

That is, the formation of the thermal transfer printing sheet 50*e*, which includes the release sheet 18, the film-like thermoplastic resin pattern 49 forming the transfer base material, and the mirror image 48, is completed by the processing from the above-mentioned first step to the above-mentioned fifth step.

Subsequently, FIG. 8F shows a sixth step. In FIG. 8F, first, the thermal transfer printing sheet 50*e* is superimposed on a transfer medium 52 such as a T-shirt by using, for example, a heating press 51 sold in a market so that a mirror image-formation surface 50*e*-1 faces the transfer medium 52.

Further, the thermal transfer printing sheet 50*e*, which includes the mirror image 48 to be printed on the surface thereof, is bonded to the transfer medium 52 with the film-like thermoplastic resin pattern 49, which forms the transfer base material, interposed therebetween by heat and pressure applied from a hack surface 50*e*-2 of the thermal transfer printing sheet 50*e* opposite to the mirror image-formation surface so that the release sheet 18 can be detached after cooling.

Meanwhile, even in the case of this embodiment, the thermal transfer printing sheet 50*c* may be bonded to the transfer medium 52 with the film-like thermoplastic resin pattern 49 interposed therebetween by manual ironing without the use of the heating press 51.

After that, when the thermal transfer printing sheet 50*e* is cooled to about room temperature and the release sheet 18 is manually detached, a transfer image 53*e*, which has been changed into a normal image 48*a* from the mirror image 48, is completely formed on the transfer medium 52, which is an object to be primed such as a T-shirt, as shown in FIG. 8G. Meanwhile, in the case of this embodiment, the film-like thermoplastic resin pattern 49 as a transfer base material of a label image 53 is formed to be necessarily transparent.

The apparatuses and methods for forming a thermal transfer printing sheet and the thermal transfer printing sheets according to the first to fifth embodiments of the invention have been described above. Here, a composition for the transfer base material will be described below.

<Method of Measuring Each Property Value of Composition for Transfer Base Material>

For the measurement of a softening point, a flow tester (CFT-500D manufactured by Shimadzu Corporation) as a device, 1 g of a sample, a rate of temperature rise of 6° C./min, a load of 20 kg, and a nozzle having a diameter of 1 mm and a length of 1 mm were used to measure a softening point, and a ½ method (a temperature where the half of the sample flows out) was used.

For the measurement of the particle size of the composition for the transfer base material, FPIA-2100 (manufactured by Sysmex Corporation) as a device is used. A small amount of a sample, purified water, and a surfactant were put in a beaker and were dispersed by an ultrasonic cleaning device. A volume average particle size (D50) was obtained as the result of a measurement.

For the measurement of a glass transition point (Tg), a differential scanning calorimeter (DSC-60 manufactured by Shimadzu Corporation) as a device, 8 mg of a sample, and a temperature rise condition where the temperature of the sample rises up to 160° C. at 10° C./min again after the temperature of the sample rises up to 160° C. at 10° C./min and the sample is cooled to 35° C. at a cooling rate of 10° C./min were used. An intersection of two tangent lines of a curved portion obtained at the time of second temperature rise by transition was defined as the glass transition point.

For the measurement of the melting point of a release agent, the same measurement as the measurement of the glass transition point was performed. The peak temperature of an endothermic curve obtained by a release agent at the time of second temperature rise was defined as a melting point. When the endothermic curve had two peaks or more, an average of the respective peaks was defined as a peak.

For the measurement of a molecular weight, a GPC (manufactured by Shimadzu Corporation) detector RI as a device was used. Molecular weight Mn is average molecular weight that is measured by GPC (gel permeation chromatography) on the basis of a calibration curve formed using a polystyrene sample of which molecular weight is known. Likewise, molecular weight Mw is weight-average molecular weight.

<Synthesis of Polybutylene Succinate that is a Main Ingredient of Composition for Transfer Base Material>

As a first synthesis example, 5 parts by mass of 88% aqueous solution of lactic acid, where 0.4 parts by mass of malic acid and 1 part by mass of germanium dioxide are dissolved, were added to 100 parts by mass of succinic acid and 89 parts by mass of 1,4-Butanediol. After a nitrogen atmosphere was formed in a reaction system, a reaction was performed for 1 hour at 220° C. Then, while temperature was made to rise to 230° C., pressure was reduced to 70 Pa for 1.5 hours. In addition, polybutylene succinate was obtained by polymerization that was performed for two hours.

As a second synthesis example, a polybutylene succinate adipic acid resin was obtained by the same method as the first synthesis example except that 85 parts by mass of succinic acid and 19 parts by mass of adipic acid were used instead of 100 parts by mass of succinic acid (85/15 at molar ratio).

As a third synthesis example, a polybutylene succinate sebacic acid resin was obtained by the same method as the first synthesis example except that 85 parts by mass of succinic acid and 26 parts by mass of sebacic acid were used instead of 100 parts by mass of succinic acid (85/15 at molar ratio).

<Manufacture of Composition for Transfer Base Material>

First manufacture example of composition for transfer base material: 96.5 parts by mass of polybutylene succinate obtained in the first synthesis example, 1 part by mass of LR-147 manufactured by Japan Carlit Co., Ltd. as a charging control agent, and 2.5 parts by mass of carnauba wax (manufactured by S. Kato & Co.) were mixed and were kneaded by a biaxial extrusion kneading machine. A kneaded material was pulverized under liquid nitrogen atmosphere by Linrex Mill manufactured by Hosokawa Micron Corporation, so that powder having D50 (volume) of 37 μm was obtained.

After that, 100 parts by mass of obtained particles are hydrophobized silica particles; 0.4 parts by mass of TG810G manufactured by Cabot Corporation and 1.4 parts by mass of RY50 manufactured by Nippon Aerosil Co. Ltd. were agitated by a Henschel mixer and externally added, so that a composition 1 for a transfer base material was obtained (D50 (volume) of 37 μm and a softening point of 125° C.).

Second and third manufacture examples of composition for transfer base material: compositions 2 and 3 for the transfer base material were obtained by the same method as the first manufacture example of the composition for the transfer base material except that a polyester resin obtained in the second and third synthesis examples was used. The composition 2 for the transfer base material has D50 (volume) of 44 μm and a softening point of 105° C. The composition 3 for the transfer base material has D50 (volume) of 38 μm and a softening point of 95° C.

Fourth manufacture example of composition for transfer base material: a composition 4 for a transfer base material (D50 (volume) of 33 μm and a softening point of 126° C.) was obtained by the same method as the first embodiment except that 81.5 parts by mass of polybutylene succinate obtained in the first synthesis example, 15 parts by mass of titanium oxide CR-60 manufactured by Ishihara Sangyo Kaisha Ltd., 1 part by mass of LR-147 manufactured by Japan Carlit Co., Ltd., 2.5 parts by mass of carnauba wax (manufactured by S. Kato & Co.) were used as raw materials.

Fifth manufacture example of composition for transfer base material: a composition 5 for a transfer base material (D50 (volume) of 43 μm and a softening point of 131° C.) was obtained by external addition using the same method as the first embodiment except that fine resin particles of a polyvinyl acetal resin S-LEC BL-2 manufactured by Sekisui Chemical Co., Ltd. were used as a raw material.

Sixth manufacture example of composition for transfer base material: marine biological material-polylactic acid REVODE101 was mixed to a polyethylene glycol resin, and the mixture thereof was kneaded by a biaxial extrusion kneading machine. A kneaded material discharged from the kneading machine was submerged in water as it is, so that polyethylene glycol was dissolved in water.

After that, precipitated polylactic acid particles were gathered and were dispersed in ion-exchanged water again. The same cleaning work was repeated seven times. Coarse particles were removed from cleaned polylactic acid particles through a mesh having an aperture of 32 μm. After that, a composition 6 for a transfer base material (D50 (volume) of 27 μm and a softening point of 158° C.) was obtained by drying and the same external addition as the first manufacture example of the composition for the transfer base material.

Seventh manufacture example of composition for transfer base material: a composition 7 for a transfer base material (D50 (volume) of 46 μm and a softening point of 156° C.) was obtained by external addition using the same method as the first embodiment except that a low-density polyethylene resin NOVATEC LD LF240 manufactured by Japan Polyethylene Corporation was used as a raw material.

<Printing on Shirt>

Meanwhile, in the following description, a release sheet having a release surface will be referred to as a separator.

First print example after a color mirror surface image was developed on a transparent separator made of PET by a N5300 printer manufactured by Casio Computer Co., Ltd., the composition 1 for the transfer base material was developed so as to cover the color image and thermally fixed. The thickness of the fixed composition 1 for the transfer base material was 50 μm.

After that, the toner development surface was adjusted so as to come into contact with the printing point of a plain white T-shirt and a warmed iron is pressed against the back surface of the separator. After the T-shirt was sufficiently cooled to about room temperature, the transparent separator was detached. As a result, it was possible to form an image on the T-shirt. The obtained T-shirt was washed by a washing machine, and the state of the washed T-shirt was checked.

Second to fourth print examples, first to third comparative examples: an image was formed on the T-shirt in the same manner as the manner of the first print example by using the compositions 2 to 5 for the transfer base material.

Fifth and sixth print examples: an image was formed on a T-shirt in the same manner as the manner of the first print example by using the compositions 1 and 2 for the transfer base material except that a plain black T-shirt was used.

Seventh print example: a T-shirt was formed in the same manner as the manner of the first print example except that a release sheet, which includes a transparent polyurethane resin layer having a melting temperature of 200° C. or more (which is equal to or higher then the temperature of the iron), was used on a release sheet made of PET.

<Evaluation of T-shirt>

About the shirts, which were obtained in the first to seventh print examples by using the compositions for the transfer base material of the first to seventh manufacture examples of the composition for the transfer base material, the results, which were evaluated as "○", "Δ", and "×", of a fixing property of an image to fabric, launderability, fixing temperature (a softening point of a composition for a transfer base material), and an imaging property as evaluation items were shown in Table 1.

TABLE 1

| | Compositions for the transfer base material | Type of resin | Fixing property of an image to fabric | Launderability | Fixing temperature | Imaging property |
|---|---|---|---|---|---|---|
| Example 1 | 1 | polybutylene succinate | ○ | ○ | ○ (125° C.) | ○ |
| Example 2 | 2 | polybutylene succinate | ○ | ○ | ○ (126° C.) | ○ |
| Example 3 | 3 | polybutylene succinate adipic acid | ○ | ○ | ○ (105° C.) | ○ |
| Example 4 | 4 | polybutylene succinate sebacic acid | ○ | ○ | ○ (95° C.) | ○ |
| Example 5 (Black shirt) | 1 | polybutylene succinate | ○ | ○ | ○ (125° C.) | Δ |
| Example 6 (Black shirt) | 4 | polybutylene succinate | ○ | ○ | ○ (126° C.) | ○ |
| Comprative Example 1 | 5 | polyvinyl acetal | x | x | ○ (131° C.) | ○ |
| Comprative Example 2 | 6 | polylactic acid | Δ | Δ | x (158° C.) | ○ |
| Comprative Example 3 | 7 | low-density polyethylene | x | x | x (156° C.) | x |

According to the summary using Table 1, the first to fourth print examples were excellent in all items. Since an image was formed on a black shirt in the case of the fifth print example, the visibility of the image was slightly poor.

However, since a white layer was formed between the black shirt and the image when a toner 4, which was formed by making titanium oxide be contained in the toner as a transfer base material, was used, the visibility of the image had no problem. That is, when a deep-colored shirt is used, it is possible to improve an imaging property by using a composition, which is not transparent and is white, as a composition for a transfer base material as a transfer base material.

The first comparative example was inferior in the fixing property and launderability. The second comparative example was slightly inferior in the fixing property and launderability even though not as much as the first comparative example. The third comparative example was obviously poor in the fixing property to fabric.

Even though ironing was performed on the image of the T-shirt obtained in the fifth print example, it was possible to prevent toner from being fused to the iron without the collapse of the image. In the other print examples, toner was fused to the iron and the image did collapse.

Meanwhile, transfer printing methods, which are particularly effective for fabric products, such as T-shirts or trainers, have been described in the above-mentioned examples. However, the printing methods may be applied to objects to be transferred and printed, such as metal, wood, resins, paper, and ceramics.

Further, 1,4-Butanediol has been used in the synthesis of polybutylene succinate that is a main ingredient of the composition for the transfer base material. However, straight-chain terminal diol, such as ethylene glycol, 1,3-propanediol, 1,5-Pentanediol, 1,6-hexanediol, 1,7-heptanediol, 1,8-octanediol, 1,9-nonanediol, 1,10-decanediol, and 1,12-dodecanediol, may be used other than 1,4-butanediol.

In addition, branched diol, such as 2-methyl-1,3-propanediol, 2,2-dimethyl-1,3-propanediol, 2,5-hexanediol, 1,2-propanediol, 1,2-butanediol, 1,3-butanediol, 1,2-cyclohexane dimethanol, 1,3-cyclohexane dimethanol, and 1,4-cyclohexane dimethanol, are also considered effective. Two or more of these may be used.

Further, dicarboxylic acid different from succinic acid may also be copolymerized. The following are considered as the dicarboxylic acid. That is, oxalic acid, malonic acid, glutaric acid, adipic acid, suberate, sebacic acid, cyclohexanedicarboxylic acid, fumaric acid, maleic acid, phthalic acid, isophthalic acid, terephthalic acid, and the like may be considered as the dicarboxylic acid.

In particular, if a film to be thermally transferred is soft in the print of a T-shirt, launderability is improved. For this reason, a countermeasure for softening polybutylene succinate by the copolymerization or the like of adipic acid is considered effective.

Having described and illustrated the principles of this application by reference to one preferred embodiment, it should be apparent that the preferred embodiment may be modified in arrangement and detail without departing from the principles disclosed herein and that it is intended that the application be construed as including all such modifications and variations insofar as they come within the spirit and scope of the subject matter disclosed herein

The invention claimed is:

1. An apparatus for forming a thermal transfer printing sheet, the apparatus comprising:

a release sheet feeder that feeds a release sheet having a release surface;

a first image forming section that transfers an image, which is to be thermally transferred and printed on a transfer medium, onto the release surface of the release sheet;

a second image forming section that forms a thermoplastic resin pattern corresponding to the image as a transfer base material and transfers the thermoplastic resin pattern onto the release surface of the release sheet; and a fixing section that fixes the image and the thermoplastic resin pattern onto the release surface of the release sheet in a film shape, through heat and pressure.

2. The apparatus according to claim 1, wherein the first image forming section comprises:

a first developing section that develops the image on a photoreceptor; and a first transfer section that transfers the image developed on the photoreceptor onto the release surface of the release sheet, and wherein the second image forming section comprises:

a second developing section that develops the thermoplastic resin pattern on a photoreceptor; and a second transfer section that transfers the thermoplastic resin pattern developed on the photoreceptor onto the release surface of the release sheet.

3. The apparatus according to claim 2, further comprising:

a re-conveying section that feeds the release sheet having passed through the fixing section to the first image forming section or the second image forming section.

4. The apparatus according to claim 3, wherein the image is a mirror image.

5. The apparatus according to claim 1, wherein the image is a mirror image.

6. A method of forming a thermal transfer printing sheet, the method comprising:

(a) feeding a release sheet having a release surface;

(b) transferring an image, which is to be thermally transferred and printed on a transfer medium, onto the release surface of the release sheet;

(c) forming a thermoplastic resin pattern corresponding to the image as a transfer base material and transferring the thermoplastic resin pattern onto the release surface of the release sheet; and (d) fixing the image and the thermoplastic resin pattern onto the release surface of the release sheet in a film shape, through heat and pressure.

7. The method according to claim 6, wherein the step (b) comprises:

(b-1) developing the image on a photoreceptor; and (b-2) transferring the image developed on the photoreceptor onto the release surface of the release sheet, and wherein the step (c) comprises:

(c-1) developing the thermoplastic resin pattern on a photoreceptor; and (c-2) transferring the thermoplastic resin pattern developed on the photoreceptor onto the release surface of the release sheet.

8. The method according to claim 7, wherein the steps (b) including (b-1) and (b-2), (c) including (c-1) and (c-2), and (d) are performed in order and wherein step (c) comprises forming the thermoplastic resin pattern onto the release surface of the release sheet so as to cover at least a part of the image.

9. The method according to claim 8, wherein the image is a mirror image.

10. The method according to claim 7, wherein the step (b) is performed after the step (c), and the step (d) is performed after the step (b), wherein the step (b) comprises transferring the image onto the release surface of the release sheet so as to form the image on the thermoplastic resin pattern.

11. The method according to claim 7, wherein the step (b) comprises transferring the image onto the release surface of the release sheet and fixing the image on the release surface of the release sheet through heat and pressure, and wherein the steps (b) including (b-1) and (b-2), (c) including (c-1) and (c-2), and (d) are performed in order.

12. The method according to claim 7, wherein the step (c) comprises transferring the thermoplastic resin pattern onto the release surface of the release sheet and fixing the thermoplastic resin pattern on the release sheet through heat and pressure, and wherein the step (b) is performed after the step (c), and the step (d) is performed after the step (b).

13. The method according to claim 6, wherein the steps (b) to (d) are performed in order, and wherein the step (c) comprises forming the thermoplastic resin pattern onto the release surface of the release sheet so as to cover at least a part of the image.

14. The method according to claim 6, wherein the step (b) is performed after the step (c), and the step (d) is performed after the step (b), and wherein the step (b) comprises transferring the image onto the release surface of the release sheet so as to form the image on the thermoplastic resin pattern.

15. The method according to claim 6, wherein the step (b) comprises transferring the image onto the release surface of the release sheet and fixing the image onto the release surface of the release sheet through heat and pressure, and wherein the steps (b) to (d) are performed in order.

16. The method according to claim 6, wherein the step (c) comprises transferring the thermoplastic resin pattern onto the release surface of the release sheet and fixing the thermoplastic resin pattern onto the release surface of the release sheet through heat and pressure, and wherein the step (b) is performed after the step (c), and the step (d) is performed after the step (b).

17. The method according to claim 6, wherein the image is a mirror image.

18. A thermal transfer printing method, comprising:

(a) forming a thermal transfer printing sheet, the step (a) comprising:

(i) feeding a release sheet having a release surface;

(ii) transferring an image onto the release surface of the release sheet;

(iii) forming a thermoplastic resin pattern corresponding to the image as a transfer base material and transferring the thermoplastic resin pattern onto the release surface of the release sheet; and (iv) fixing the image and the thermoplastic resin pattern onto the release surface of the release sheet in a film shape, through heat and pressure;

(b) disposing the thermal transfer printing sheet on a transfer medium such that the release surface faces the transfer medium;

(c) pressing the thermal transfer printing sheet against the transfer medium while heating the thermal transfer printing sheet and the transfer medium; and (d) removing the release sheet thereby to form the transfer medium on which the image and the thermoplastic resin pattern are transferred and printed.

* * * * *